US005682582A

United States Patent [19]

Ogasawara et al.

[11] Patent Number: 5,682,582

[45] Date of Patent: Oct. 28, 1997

[54] PROCESS UNIT OF IMAGE FORMING APPARATUS

[75] Inventors: Masato Ogasawara, Tokyo; Yoshitsugu Nakatomi, Mishima, both of Japan

[73] Assignee: Kabushiki Kaisha TEC, Shizuoka, Japan

[21] Appl. No.: 510,298

[22] Filed: Aug. 2, 1995

[30] Foreign Application Priority Data

Aug. 5, 1994 [JP] Japan ..... 6-184272

[51] Int. Cl.[6] ..... G03G 15/02

[52] U.S. Cl. ..... 399/174; 361/225; 399/175

[58] Field of Search ..... 355/219; 361/225, 361/220, 230; 399/168, 174, 175

[56] References Cited

U.S. PATENT DOCUMENTS

| | | | |
|---|---|---|---|
| 5,008,706 | 4/1991 | Ohmori et al. | 355/219 |
| 5,151,734 | 9/1992 | Tsuda et al. | 355/200 |
| 5,192,974 | 3/1993 | Ikegawa et al. | 355/219 |
| 5,278,614 | 1/1994 | Ikegawa et al. | 355/219 |
| 5,376,995 | 12/1994 | Yamamoto et al. | 355/219 |
| 5,398,102 | 3/1995 | Wada et al. | 355/219 |
| 5,402,213 | 3/1995 | Ikegawa et al. | 355/219 |
| 5,479,244 | 12/1995 | Kashihara et al. | 355/219 |

FOREIGN PATENT DOCUMENTS

| | | | |
|---|---|---|---|
| 0110872 | 4/1992 | Japan | 355/219 |
| 0250489 | 9/1994 | Japan | 355/219 |

*Primary Examiner*—Matthew S. Smith

*Attorney, Agent, or Firm*—Oblon, Spivak, McClelland, Maier & Neustadt, P.C.

[57] ABSTRACT

The present invention comprises a photosensitive member supported for rotation within a unit case and a charger for uniformly charging the photosensitive member. The charger includes a conductive member in the form of a sheet held in contact with the photosensitive member and a supporting member having a non-flat cross section for supporting the conductive member, in which the charger applies a voltage formed of a direct-current voltage with an alternating-current voltage added thereto to the conductive member to thereby uniformly charge the photosensitive member. The charger is kept in place by having the supporting member fixed to vertical planes of the unit case at positions off vertical planes crossing the photosensitive member. Thus, rigidity of both the supporting member itself and that of the portions where the supporting member and the unit case are fixed together are made higher and, in addition, the portions where the supporting member and the unit case are fixed together are positioned off the portion on which a varying attractive force between the photosensitive member and the conductive member acts. Accordingly, the unit case hardly vibrates and noise is hardly produced.

22 Claims, 7 Drawing Sheets

PROCESS UNIT OF IMAGE FORMING APPARATUS

BACKGROUND OF THE INVENTION

1. Field of the Invention

The present invention relates to a process unit of an image forming apparatus having at least a photosensitive member and a charger on a contact charging system to electrify the photosensitive member by contact charging.

2. Description of the Related Art

In an image forming apparatus on an electrophotographic system, it is generally practiced to put expendable parts, such as a developer including a toner and a cleaner, into a unit and to detachably attach such unit to the body of the image forming apparatus. In recent years, the range of parts to be put into a unit has been expanded for such reasons as ease of maintenance and there is a tendency that all of the parts related to the process for image formation, such as the photosensitive member and the charger for uniformly charging the photosensitive member, are put into a unit as a process unit.

In such process unit, photosensitive members smaller in diameter have come to be frequently used to meet the requirement for apparatuses in smaller size. When the diameter of the photosensitive member is made as small as 20 mm or below, it becomes difficult to properly arrange the parts that have to be disposed around the photosensitive member. While chargers on a discharge-electrification system utilizing a corona discharge are being in wide use now, the charger on such system is virtually equal in size to the photosensitive member being 20 mm or so in diameter. Therefore, when such charger on the discharge-electrification system is combined with a photosensitive member being 20 mm or so in diameter, the arrangement of other parts in association with them becomes extremely difficult. Under such situation, there have been spread chargers on a contact charging system for electrifying a photosensitive member through a conductive member placed in contact with the photosensitive member. As an example of a process unit having such charger on the contact charging system, a process unit developed by us is shown in FIG. 7 to FIG. 9.

Referring to FIG. 7, which shows a general structure of a process unit 1, a photosensitive member 2, a charger 3, a developer 4, and a cleaner 5 are incorporated in a unit case 6 to thereby form one unit. In the unit case 6, there are formed openings 7*a* and 7*b* so that the photosensitive member 2 may be exposed upward and downward. The opening 7*a* formed at the top of the unit case 6 is that allowing a transfer roller, not shown, to be put into contact with the photosensitive member 2 and the opening 7*b* formed at the bottom of the unit case 6 is that allowing light emitted from an optical system, not shown, to be led to the photosensitive member 2. The transfer roller and the optical system are disposed on the side of the body of the image forming apparatus, not shown.

The charger 3 is that on a contact charging system. Namely, as shown in FIG. 7 to FIG. 9, the charger 3 is formed of a conductive member 8 in the shape of a flexible sheet, placed in contact with the photosensitive member 2 and adhesively fixed to an L-formed supporting member 9, the supporting member 9 fixed to the unit case 6 by screws 11 through a spacer 10, and a power supply 12 connected to the supporting member 9 being conductive. The power supply 12 is adapted to supply a voltage formed of a direct current component DC with an alternating current component AC added thereto to the conductive member 8 through the supporting member 9.

In the described structure, when a voltage formed of a DC voltage with an AC voltage added thereto is applied by the power supply 12 to the conductive member 8 of the charger 3, the surface of the photosensitive member 2, which, while rotating in a clockwise direction, is held in contact with the conductive member 8, is uniformly charged. The photosensitive member 2 that has thus been charged is irradiated by light from the optical system, not shown, and an electrostatic latent image is formed thereon. The electrostatic latent image is developed into a real image by being supplied with a toner in the developer 4, and the thus realized image is transferred to transfer paper by a transfer roller, not shown. Thereafter, the toner remaining on the photosensitive member 2 is removed by the cleaner 5.

The reason why the conductive member 8 of the charger 3 is adapted to be supplied with the voltage formed of a direct current component DC with an alternating current component AC added thereto is that, while the photosensitive member 2 cannot be uniformly charged when the direct current component DC only is applied thereto, the potential generated on the surface of the photosensitive member 2 is made even and, hence, the photosensitive member 2 is uniformly charged when the alternating current component AC is added.

A problem with such conventional apparatus will be described. When a voltage is applied to the conductive member 8 of the charger 3 by the power supply 12 in order to charge the photosensitive member 2, an electric attractive force is generated between the photosensitive member 2 and the conductive member 8 and thereby the conductive member 8 is pressed against the photosensitive member 2. Since AC voltage is also applied to the conductive member 8 at this time, the attractive force between the photosensitive member 2 and the conductive member 8 varies sinusoidally. The variation in the attractive force acts on the supporting member 9 supporting the conductive member 8 causing a sinusoidal vibration in the supporting member 9. Then, the vibration in the supporting member 9 is transferred to the unit case 6 causing the unit case 6 also to vibrate, and thereby such a problem arises that the vibration is propagated through air to cause a noise.

If the vibration is analyzed in more detail, the directions of the varying attractive force between the photosensitive member 2 and the conductive member 8 are as indicated by the arrowheads A in FIG. 9. Meanwhile, the portion at which the unit case 6 and the supporting member 9 are joined is subject to the varying attractive force acting in the directions indicated by the arrowheads A in FIG. 9. Namely, while the portion at which the unit case 6 and the supporting member 9 are joined has high rigidity in the direction Z in FIG. 9, it has low rigidity in the directions X and Y. Accordingly, the joint portion readily vibrates with the varying attractive force between the photosensitive member 2 and the conductive member 8 applied thereto.

Further, the screws 11 joining the unit case 6 and the supporting member 9 together are disposed in the vertical planes crossing the photosensitive member 2, i.e., the planes formed by the axes X and Y in FIG. 9. The vertical plane including the photosensitive member 2 is the plane along which the action due to the variation in the attractive force between the photosensitive member 2 and the conductive member 8 is exerted. Thus, the variation in the attractive force acts on the screws 11 and causes the screws 11 to vibrate. Then, the vibration produced in the screws 11 are transferred to the unit case 6 so that the unit case 6 is also caused to vibrate.

SUMMARY OF THE INVENTION

An object of the present invention is to provide a process unit of an image forming apparatus capable of reducing vibration accompanying charging operation of the photosensitive member.

Another object of the invention is to provide a process unit of an image forming apparatus which is simple in structure.

A further object of the invention is to provide a process unit of an image forming apparatus which is easy to fabricate.

The present invention comprises a photosensitive member supported for rotation within a unit case and a charger applying a voltage formed of a direct-current voltage with an alternating-current voltage added thereto to thereby uniformly charge the photosensitive member. The charger includes a conductive member in the form of a sheet held in contact with the photosensitive member and a supporting member having a non-flat cross section for supporting the conductive member. The charger is fixed in place by having the supporting member fixed to vertical planes of the unit case at positions off vertical planes crossing the photosensitive member or vertical planes crossing the portion at which the conductive member is supported by the supporting member. In the operation, the voltage is applied to the conductive member and the photosensitive member which, while rotating, is held in contact with the conductive member is uniformly charged. At this time, an electric attractive force acts between the photosensitive member and the conductive member. The attraction between the photosensitive member and the conductive member varies sinusoidally because an alternating current component is included in the voltage applied to the conductive member. Such variation in the attractive force tends to cause vibrations in other components located in the planes crossing the photosensitive member. Against the action, the supporting member has a non-flat cross section and, hence, it is superior in rigidity to that having a flat cross section and, hence, the supporting member itself hardly vibrates. Further, while the supporting member itself is in the form less rigid in the direction along which the varying attractive force between the photosensitive member and the conductive member acts, the charger fixing means fixes the supporting member to the unit case in the direction perpendicular to the direction of the varying attractive force and, therefore, the rigidity at the joint between the supporting member and the unit case is improved and the unit case hardly vibrates. Furthermore, since the position where the supporting member is fixed to the unit case by the charger fixing means is off the portion on which varying attractive force between the photosensitive member and the conductive member acts and, accordingly, vibration is hardly transmitted to the unit case and noise production is reduced.

BRIEF DESCRIPTION OF THE DRAWINGS

FIG. 6 (B) is a side view of a charger having a supporting member in a hexagonal pillar form as a variation of the charger;

DETAILED DESCRIPTION OF THE PREFERRED EMBODIMENT

An embodiment of the invention will be described with reference to FIG. 1 to FIG. 5. The embodiment is an example of a process unit 22 used in a laser printer 21 as an image forming apparatus.

[General Structure of Laser Printer 21]

Figure 2:
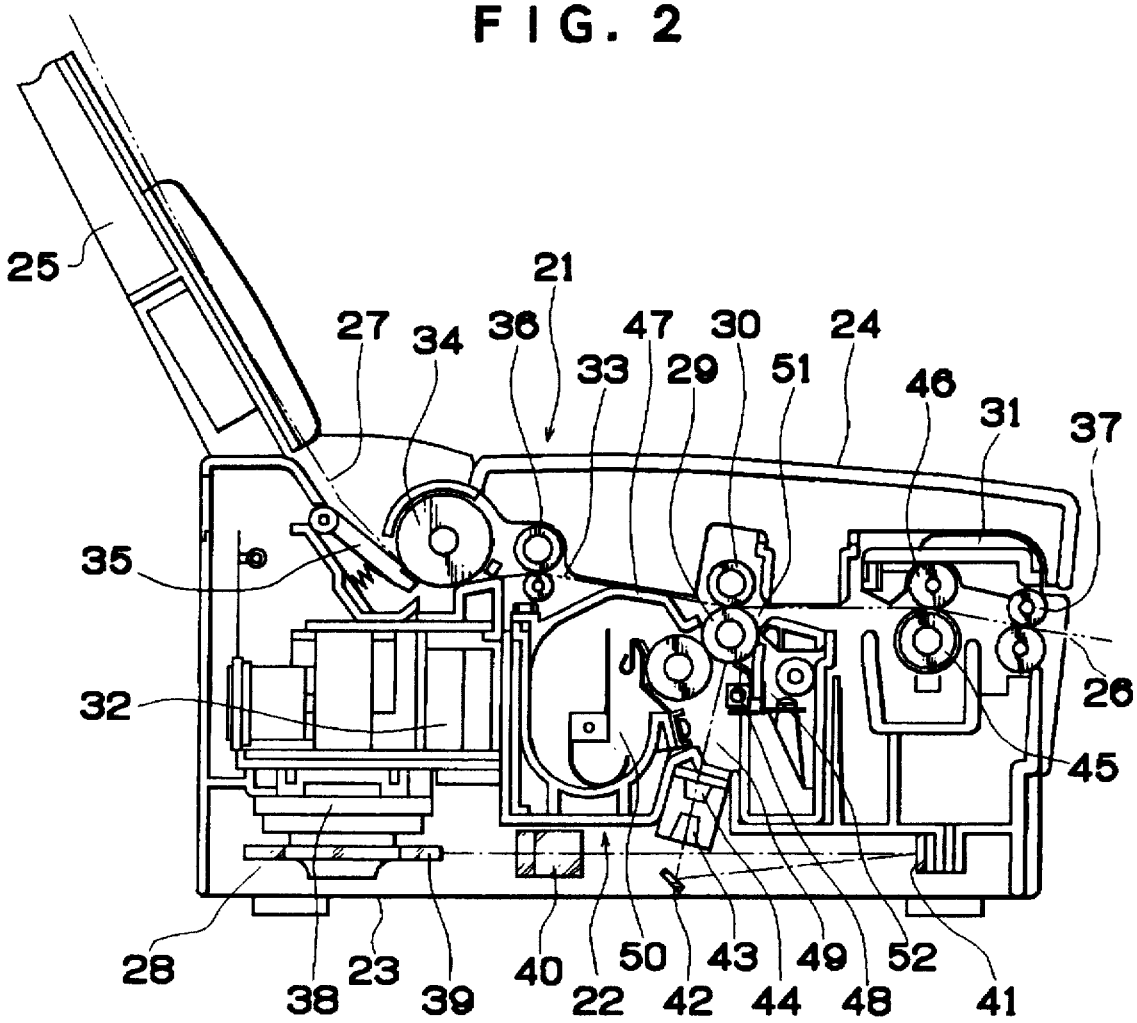
FIG. 2 is a side view in vertical section showing an image forming apparatus to which the process unit according to the present invention is applied.
Figure 3:
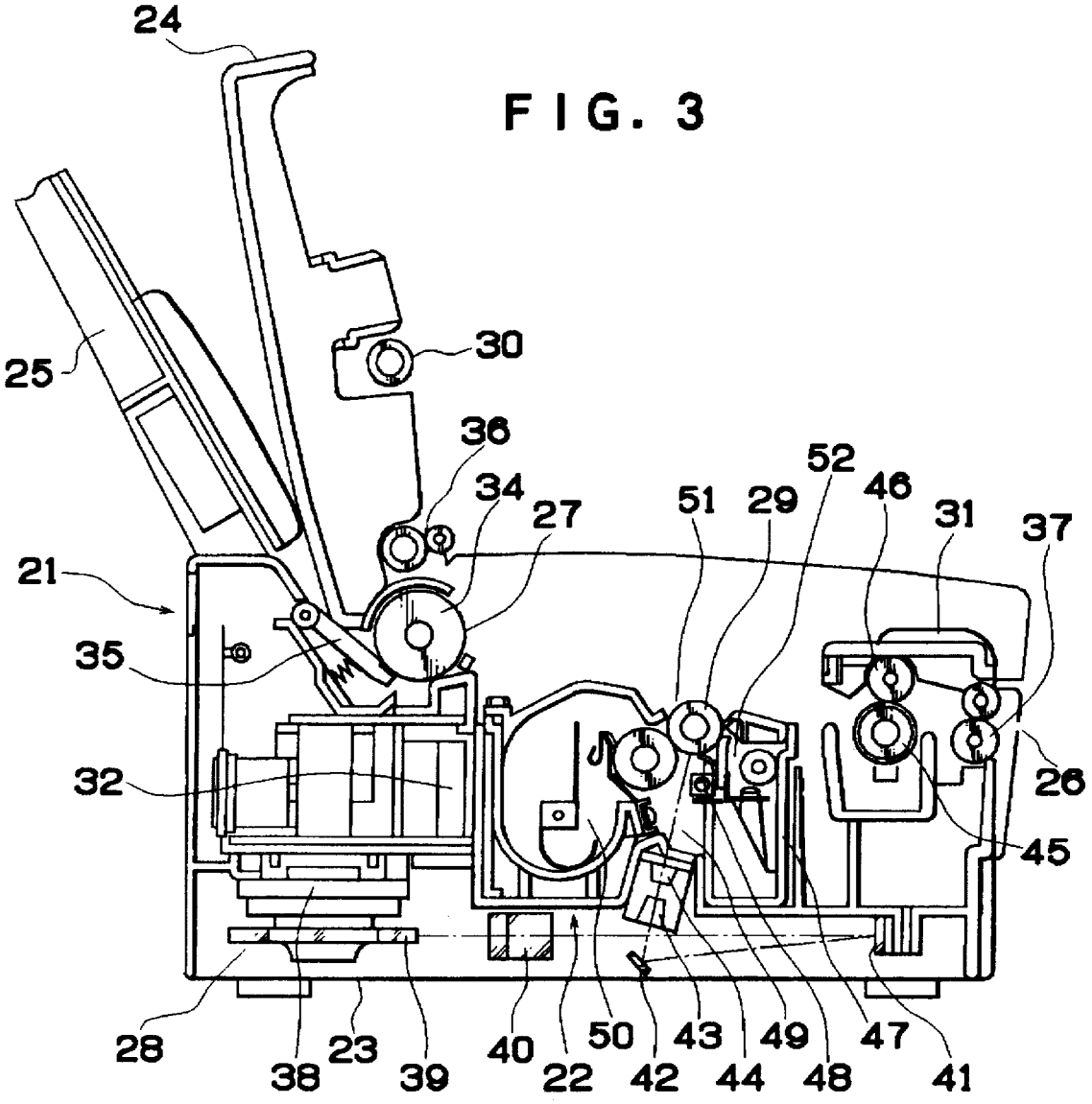
FIG. 3 is a side view in vertical section showing the image forming apparatus of FIG. 2 with the cover opened.
Figure 4:
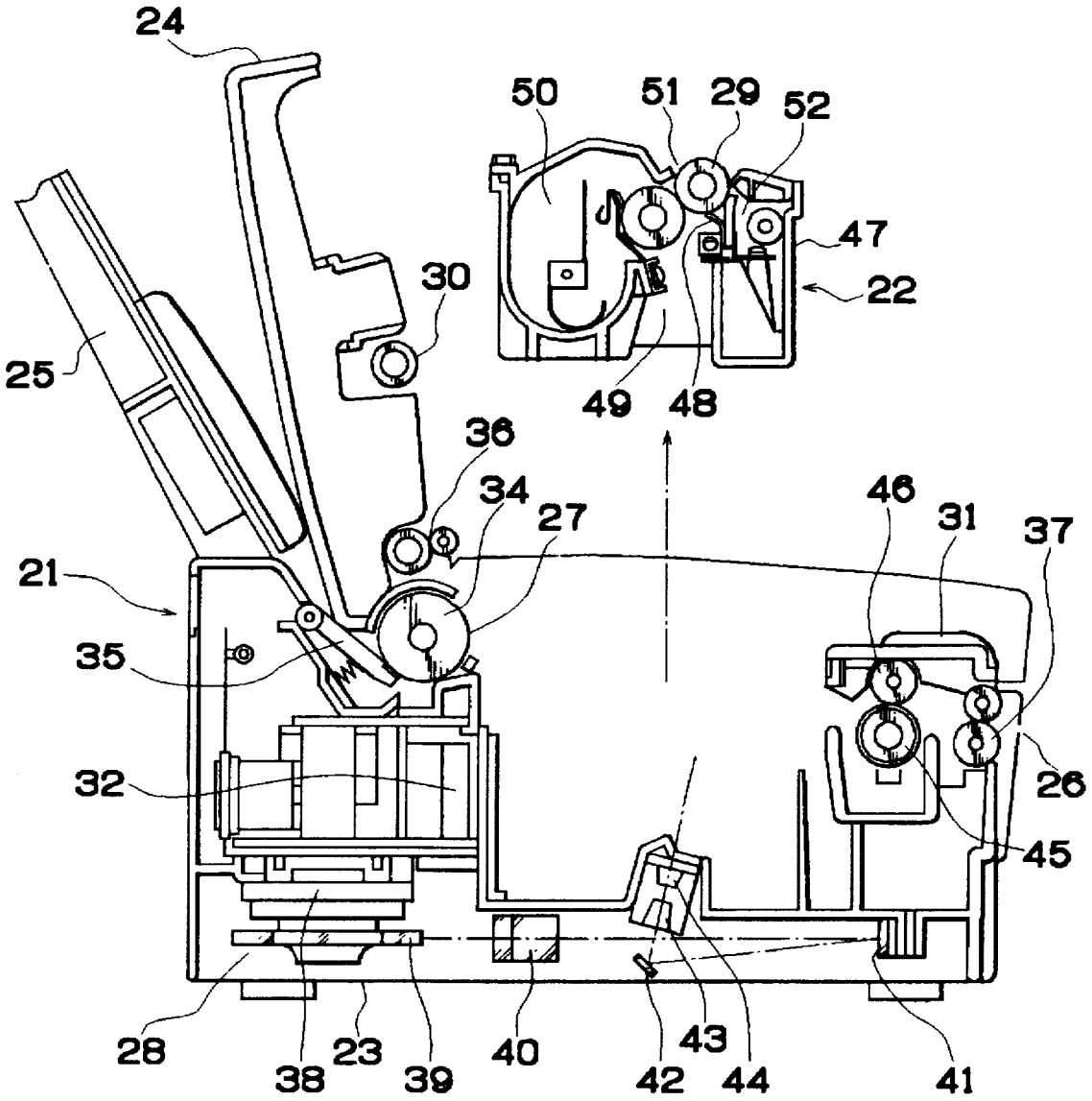
FIG. 4 is a side view in vertical section showing the image forming apparatus of FIG. 2 with the process unit detached from the body.

As shown in FIG. 2 to FIG. 4, the laser printer 21 has, as its external main components, a body case 23 shaped in the form of a flat housing, a cover 24 attached to the top of the body case 23 for opening and shutting, a paper supply tray 25 obliquely installed at the rear of the body case 23, and a paper discharging opening 26 formed in the front side of the body case 23. The laser printer 21 has, as its internal main components, a transport system 27 of transfer paper, not shown, an exposure portion 28, the process unit 22, a transfer roller 30 held in contact with a photosensitive member 29 incorporated in the process unit 22, a fixing device 31, and a drive control portion, only partly shown, including a power supply 32.

The transport system 27 is made up of a transport path 33 of transfer paper and means for transporting transfer paper arranged along the transport path 33. The means for transporting transfer paper is structured such that each sheet of paper is separated from a set of transfer paper contained in the paper supply tray 25 by means of a paper supply roller 34 and a separating device 35 and supplied to the transport path 33, the supplied transfer paper is transported by means of a transport roller 36, a pair of rollers formed of the photosensitive member 29 and the transfer roller 30, the fixing device 31, and a discharge roller 37 arranged in succession, and discharged from the paper discharging opening 26. Of the transport system 27, as shown in FIG. 3, the transport roller 36 and the transfer roller 30 are provided on the side of the cover 24 and the remaining components are provided on the side of the body case 23.

The exposure portion 28 is structured such that a laser beam emitted from a laser diode, not shown, is deflected and scanned by a polygon mirror 39 driven by a polygon motor 38, the deflected and scanned laser beam is passed through an fθ lens 40 and deflected by mirrors 41 and 42, and the deflected laser beam is passed through an fθ lens 43 and a dustproof glass 44 to irradiate the photosensitive member 29. The exposure portion 28 structured as above is provided within the body case 23 as shown in FIG. 2 to FIG. 4.

The fixing device 31, as shown in FIG. 2 to FIG. 4, is made up of a heat roller 45 and a pressure roller 46 provided within the body case 23.

[Structure of Process Unit 22]

Figure 5:
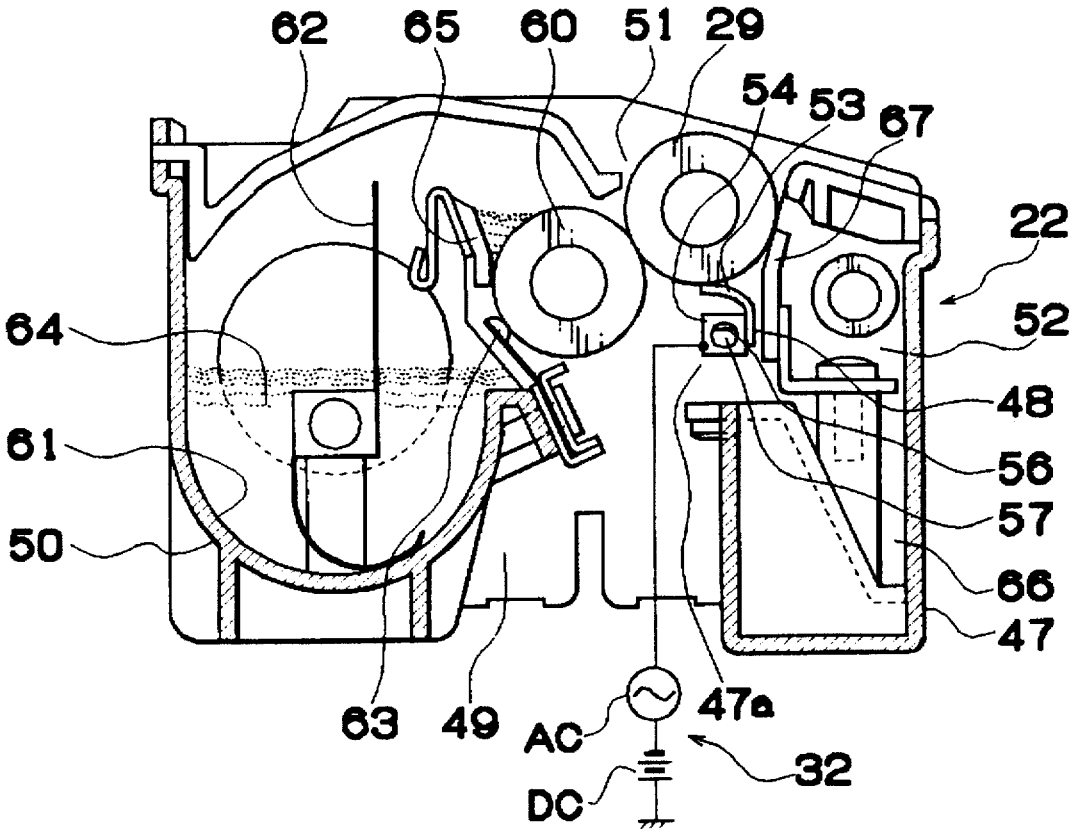
FIG. 5 is a side view in vertical section of the process unit.

The process unit 22 will be described. The process unit 22 is detachably attached to the body of the laser printer 21 as illustrated in FIG. 4. The process unit 22 is formed into a unit by having components such as the photosensitive member 29 fixed to a unit case 47 in the shape of a housing as shown in FIG. 5. More specifically, the photosensitive member 29 is fixed to the unit case 47 for rotation and there are arranged a charger 48, an opening for exposure 49 leading the laser beam from the exposure portion 28 to the photosensitive member 29, a developer 50, an opening for transfer 51 for arranging the transfer roller 30 to contact the photosensitive member 29, and a cleaner 52, such that they surround the photosensitive member 29.

Figure 1:
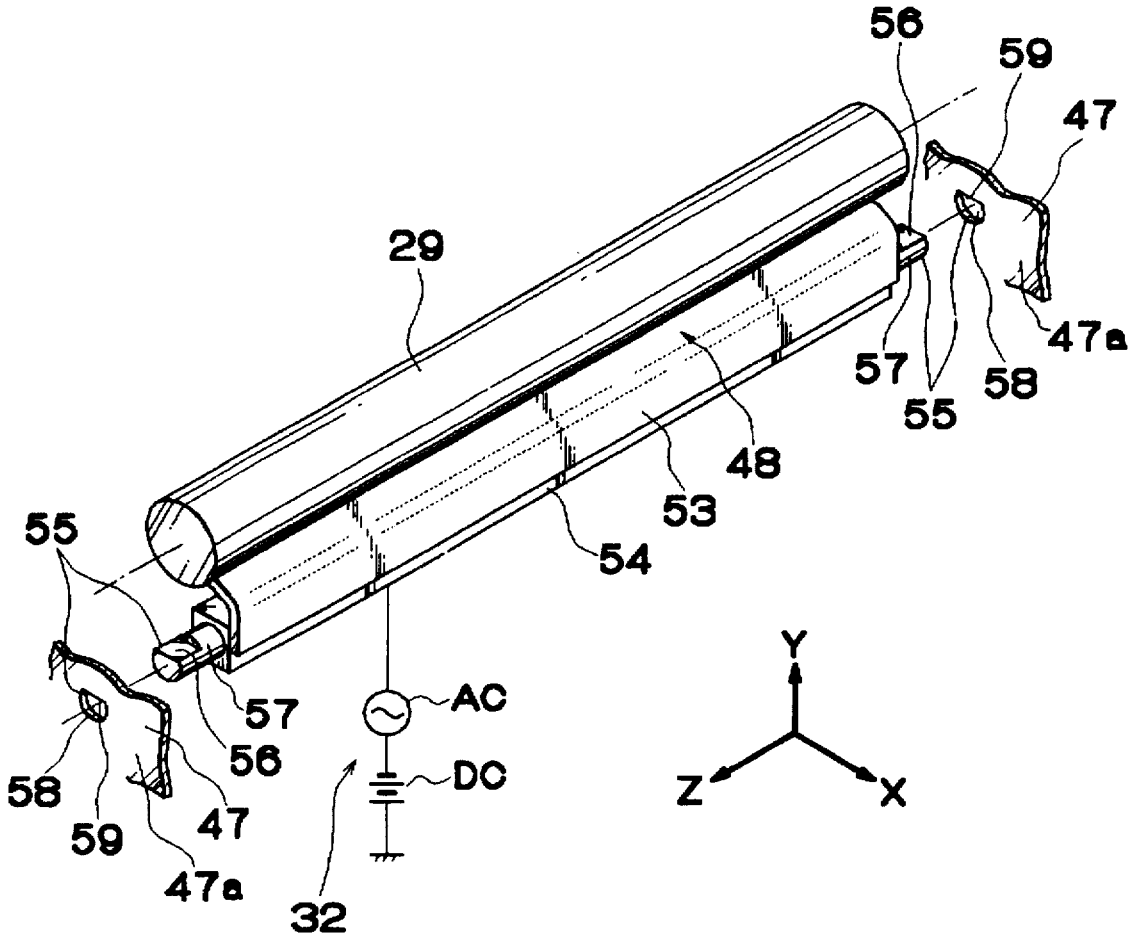
FIG. 1 is a perspective view showing a manner of fixing a charger in a process unit in an embodiment of the invention.

Structure of the charger 48 is shown in FIG. 1 and FIG. 5. The charger 48 is made up of a conductive blade 53 in the shape of a sheet as a conductive member held in contact with the photosensitive member 29, a supporting member 54 for supporting the conductive blade 53, and charger fixing means 55 for fixing the supporting member 54 to the unit case 47. The conductive blade 53 is formed of a flexible and conductive material and adhesively fixed to the supporting member 54 with a conductive adhesive. The supporting member 54 is formed of a member in the shape of a square pillar, i.e., it has a non-flat cross section. The supporting member 54 is formed of a conductive material and directly connected with the power supply 32. The power supply 32 is adapted to apply a voltage formed of a direct current component DC with an alternating current component AC added thereto to the conductive blade 53 trough the supporting member 54. As the charger fixing means 55, cylindrical projecting portions 57, which have flat faces 56 for preventing rotation, are formed projected from both ends of the supporting member 54 and there are formed fixing holes 58 in the vertical side walls 47A of the unit case 47 which allows the projecting portions 57 to fit therein. The fixing hole 58 has a straight portion on which the flat face 56 rests. By fitting the projecting portions 57 into the fixing holes 58, the charger 48 can be securely fixed to the unit case 47. Namely, by the flat face 56 formed on the projecting portion 57 and the straight portion 59 formed on the fixing hole 58, means for stopping rotation of the charger 48 can be provided.

In the above arrangement, the charger fixing means 55 are located off the vertical planes crossing the photosensitive member 29 and the vertical planes crossing the portion at which the conductive blade 53 is supported by the supporting member 54. Here, the vertical plane means the plane perpendicular to the axis of the photosensitive member 29. If the axis of the photosensitive member 29 is taken as the Z-axis in FIG. 1, the plane perpendicular to the axis of the photosensitive member 29 is formed by the X-axis and Y-axis.

The developer 50 is made up of a developing roller 60, a toner container 61, an agitating paddle 62, and a toner layer forming blade 63. The developing roller 60 is fixed to the unit case 47 for rotation in contact with the photosensitive member 29. The toner container 61 is integrally formed with the unit case 47 and holds toner 64 which is a one-component nonmagnetic toner. The agitating paddle 62 agitates the toner 64 contained in the toner container 61 and sends the toner 64 to the portion between the periphery of the developing roller 60 and a toner guide plate 65. The toner layer forming blade 63 is adapted to abut on the developing roller 60 to make the layer of the toner 64 even.

The cleaner 52 is made up of a used toner container 66 integrally formed with the unit case 47 and a cleaning blade 67 abutting on the photosensitive member 29 for cleaning off the remaining toner 64 from the periphery of the photosensitive member 29.

With the devices arranged as described above, an image is formed on transfer paper, not shown, through the processes of charging, exposure, development, transfer, and fixing. Namely, referring to FIG. 2, the surface of the photosensitive member 29 is uniformly charged by the conductive blade 53 of the charger 48 while the photosensitive member 29 is rotated clockwise, and the laser beam from the exposure portion 28 is applied to the charged portion so that an electrostatic latent image is formed thereon. As the portion where the electrostatic latent image is formed reaches the surface of the developing roller 60 of the developer 50, the toner 64 charged with frictional electricity due to friction between the toner guide plate 65 and the developing roller 60, friction between particles of the toner 64, friction between the toner layer forming blade 63 and the developing roller 60, and so on is attracted by the electrostatic latent image and, thereby, the electrostatic latent image is developed into a toner image. The toner image is transferred by the transfer roller 30 to transfer paper which has been supplied by the paper supply roller 34 and sent into the process unit 22 by the transport roller 30. The transferred image on the transfer paper passed through the transfer roller 30 is fixed by being heated and pressed in the fixing device 31 and the transfer paper finished with the fixing is discharged from the paper discharging opening 26 by the paper discharging roller 37. Thus, an image is formed on the transfer paper. The toner 64 remaining on the photosensitive member 29 after the transfer process has been performed is cleaned off by the cleaner 52 from the photosensitive member 29 and put into the used toner container 66.

Now, the process of charging with electricity of the photosensitive member 29 will be described in detail. In the charging process, a voltage from the power supply 32 is applied to the conductive blade 53 of the charger 48 through the supporting member 54. Thereby, the surface of the photosensitive member 29 which, while rotating, is held contact with the conductive blade 53 is charged. The voltage applied to the conductive blade 53 at this time is formed of a direct current component DC with an alternating current component AC added thereto and, therefore, the potential generated on the surface of the photosensitive member 29 is made even and the surface of the photosensitive member 29 is uniformly charged. In the charging of the photosensitive member 29, the application of the voltage to the conductive blade 53 causes an electric attractive force to be produced between the photosensitive member 29 and the conductive blade 53. The attractive force varies sinusoidally because the voltage applied to the conductive blade 53 includes the alternating current component AC and, hence,.sinusoidal vibrations tend to occur in the surrounding components. To suppress the vibrations, the apparatus of the embodiment is provided with the following means:

1) the supporting member 54 supporting the conductive blade 53 is given a non-flat cross section and, accordingly, it is superior in rigidity to that having a flat cross section and the supporting member 54 itself hardly vibrates;

2) while the supporting member 54 itself is in the form less rigid in the direction along which the varying attractive force between the photosensitive member 29 and the conductive blade 53 acts, the charger fixing means 55 fixes the supporting member 54 to the unit case 47 in the direction perpendicular to the direction of the varying attractive force and, therefore, the rigidity at the joint between the supporting member 54 and the unit case 47 is improved and the unit case 47 hardly vibrates; and 3) the position where the supporting member 54 is fixed to the unit case 47 by the charger fixing means 55 is off the portion on which varying attractive force between the photosensitive member 29 and the conductive blade 53 acts and, accordingly, vibrations are hardly transmitted to the unit case 47.

Because of such means taken, even if the attractive force varies sinusoidally, vibration is hardly produced in the unit case 47. Therefore, production of noise due to propagation through air of the vibration of the unit case 47 can be suppressed. Thus, while using a charger 48 on the contact charging system, a low-noise process unit 22 can be obtained.

Figure 6A:
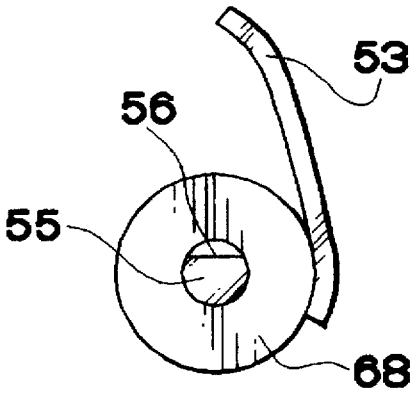
FIG. 6 (A) is a side view of a charger having a supporting member in a round bar form as a variation of the charger.
Figure 6B:
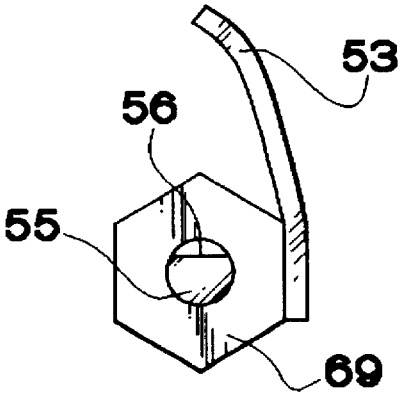
Figure 7:
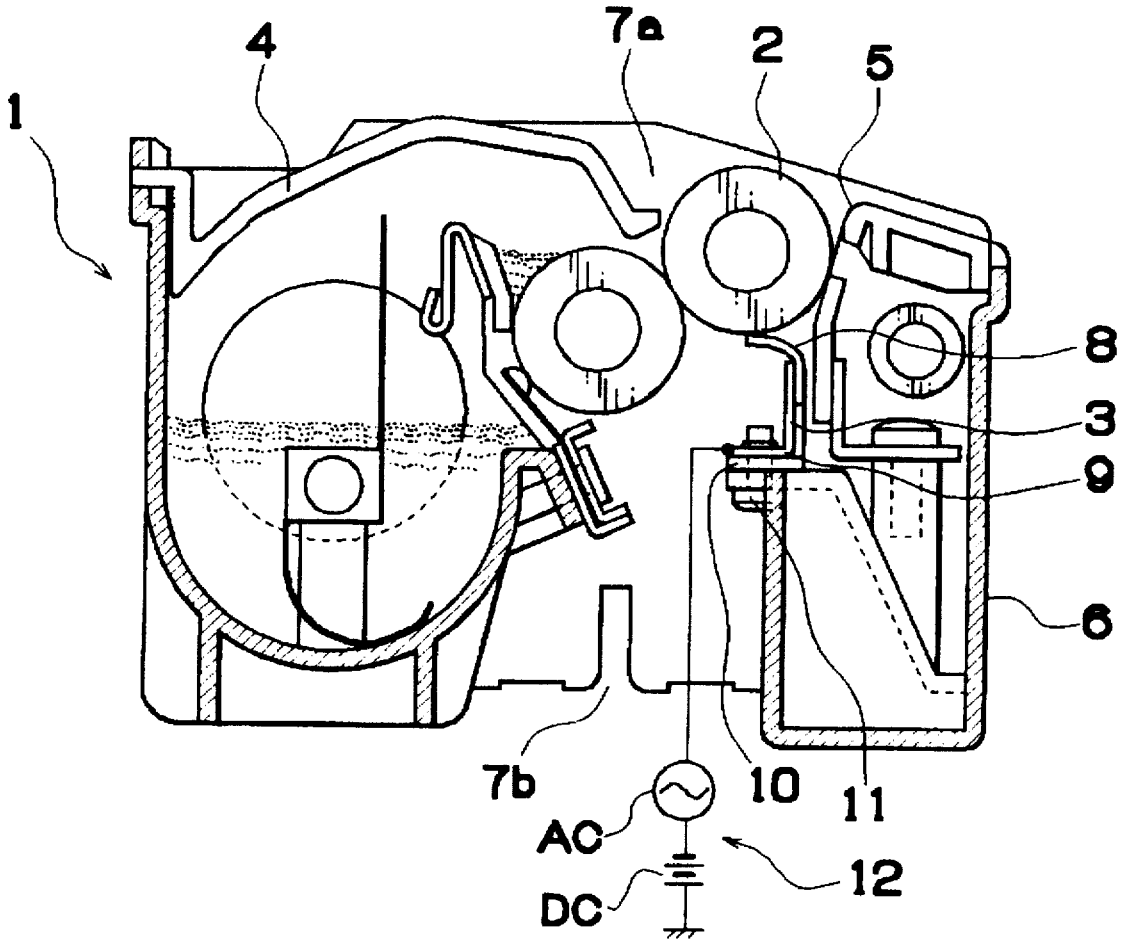
FIG. 7 is a side view in vertical section of an example of process units developed by applicants.
Figure 8:
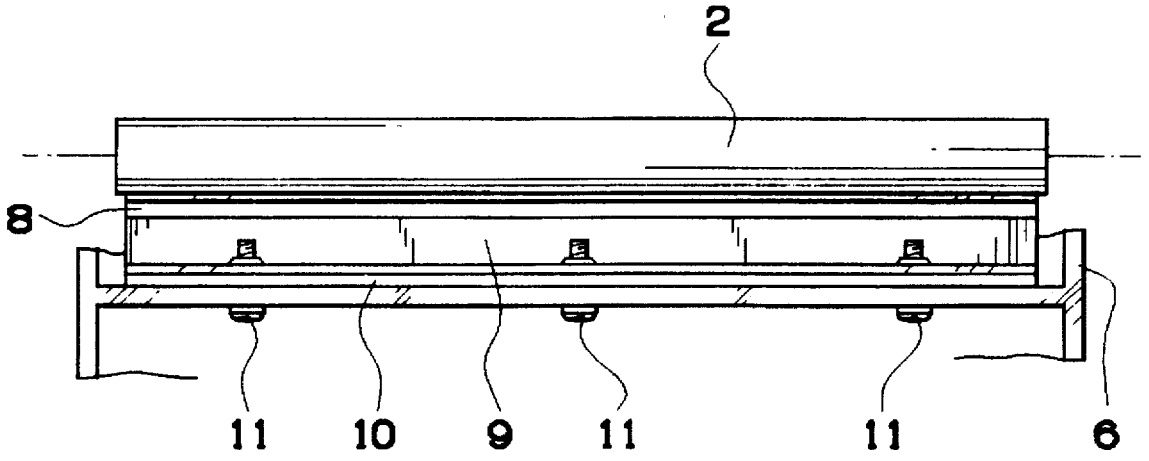
FIG. 8 is a rear view showing the manner of fixing the charger within the process unit shown in FIG. 7.
Figure 9:
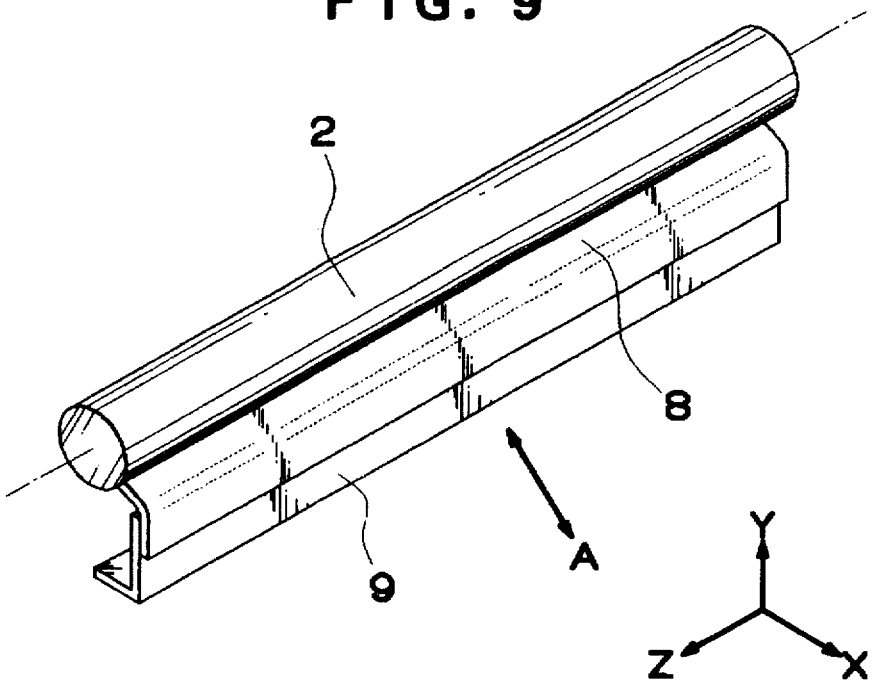
FIG. 9 is a perspective view showing relative arrangement of the photosensitive member and the charger within the process unit shown in FIG. 7.

FIG. 6(*a*) and FIG. 6(*b*) show variations of the supporting member of the charger 48. The supporting member can have any form unless the cross section is flat. Hence, as the supporting member of the charger 48, that having a round bar form 68 in FIG. 6(*a*) or that having a hexagonal pillar form 69 in FIG. 6(*b*), or the like may be used.

The above described embodiment and variations are just preferred embodiments of the invention and the scope of the invention is not limited by such preferred embodiments. It will be understood by those skilled in the art that various other changes may be made without departing from the spirit and scope of the invention.

What is claimed is:

1. A process unit of an image forming apparatus, comprising:

a photosensitive member supported for rotation within a unit case;

a charger including a conductive member in the form of a sheet held in contact with said photosensitive member and a supporting member having a non-flat cross section for supporting said conductive member, wherein said charger applies a voltage formed of a direct-current voltage with an alternating-current voltage added thereto to said conductive member to thereby uniformly charge said photosensitive member; and charger fixing means for keeping said charger in place by fixing said supporting member to vertical planes of said unit case at positions off vertical planes crossing said photosensitive member.

2. The process unit as recited in claim 1, wherein said charger fixing means is made up of projecting portions projecting from both ends of said supporting member, fixing holes formed in the vertical planes of said unit case allowing said projecting portions to be fitted therein, and rotation stopping means for stopping rotation of said charger.

3. The process unit as recited in claim 2, wherein said rotation preventing means is made up of said projecting portion whose cross section is not a circle and said fixing hole having a form allowing said projecting portion to fit therein.

4. The process unit as recited in claim 2, wherein said rotation preventing means is made up of a flat face formed on the periphery of said projecting portion in the shape of a circular cylinder and a straight portion formed as part of said fixing hole such that said flat face rests thereon.

5. The process unit as recited in claim 1, wherein said supporting member has a polygonal cross section.

6. The process unit as recited in claim 1, wherein said supporting member has a circular cross section.

7. The process unit as recited in claim 1, wherein said vertical plane of said unit case is provided by the side wall of said unit case.

8. The process unit as recited in claim 1, wherein said conductive member is adhesively attached to said supporting member with a conductive adhesive.

9. The process unit as recited in claim 1, wherein said unit case has a developer integrally formed therewith.

10. The process unit as recited in claim 9, wherein said unit case has an exposure opening for exposing said photosensitive member at a position between said charger and said developer.

11. The process unit as recited in claim 1, wherein said unit case has a cleaner integrally formed therewith.

12. A process unit of an image forming apparatus, comprising:

a photosensitive member supported for rotation within a unit case;

a charger including a conductive member in the form of a sheet held in contact with said photosensitive member and a supporting member having a non-flat cross section for supporting said conductive member, wherein said charger applies a voltage formed of a direct-current voltage with an alternating-current voltage added thereto to said conductive member to thereby uniformly charge said photosensitive member; and charger fixing means for keeping said charger in place by fixing said supporting member to vertical planes of said unit case at positions off vertical planes crossing the portion at which said conductive member is supported by said supporting member.

13. The process unit as recited in claim 12, wherein said charger fixing means is made up of projecting portions projecting from both ends of said supporting member, fixing holes formed in the vertical planes of said unit case allowing said projecting portions to be fitted therein, and rotation stopping means for stopping rotation of said charger.

14. The process unit as recited in claim 13, wherein said rotation preventing means is made up of said projecting portion whose cross section is not a circle and said fixing hole having a form allowing said projecting portion to fit therein.

15. The process unit as recited in claim 13, wherein said rotation preventing means is made up of a flat face formed on the periphery of said projecting portion shaped in the shape of a circular cylinder and a straight portion formed as part of said fixing hole such that said flat face rests thereon.

16. The process unit as recited in claim 12, wherein said supporting member has a polygonal cross section.

17. The process unit as recited in claim 12, wherein said supporting member has a circular cross section.

18. The process unit as recited in claim 12, wherein said vertical plane of said unit case is provided by the side wall of said unit case.

19. The process unit as recited in claim 12, wherein said conductive member is adhesively attached to said supporting member with a conductive adhesive.

20. The process unit as recited in claim 12, wherein said unit case has a developer integrally formed therewith.

21. The process unit as recited in claim 20, wherein said unit case has an exposure opening for exposing said photosensitive member at a position between said charger and said developer.

22. The process unit as recited in claim 12, wherein said unit case has a cleaner integrally formed therewith.

* * * * *